United States Patent [19]

Weatherley

[11] Patent Number: 4,964,818

[45] Date of Patent: Oct. 23, 1990

[54] ELECTRICAL SOCKET

[76] Inventor: Richard M. Weatherley, Sunrise, Foxenden Lane, Meopham, Kent, United Kingdom, DA13 0BP

[21] Appl. No.: 383,228

[22] Filed: Jul. 18, 1989

Related U.S. Application Data

[63] Continuation of Ser. No. 95,170, filed as PCT GB86/00717 on Nov. 24, 1986, published as WO87/03428 on Jun. 4, 1987, abandoned.

[30] Foreign Application Priority Data

Nov. 22, 1985 [GB] United Kingdom ..... 8528748
Nov. 22, 1985 [GB] United Kingdom ..... 8628010

[51] Int. Cl.[5] ..... H01R 13/42
[52] U.S. Cl. ..... 439/751; 439/741
[58] Field of Search ..... 439/56, 78, 80–84, 439/736, 345, 350, 351, 352, 353, 354, 357, 358, 741, 743, 751, 752, 869, 870, 733

[56] References Cited

U.S. PATENT DOCUMENTS

| | | | |
|---|---|---|---|
| 4,261,628 | 4/1981 | Gallagher et al. | 439/350 |
| 4,361,375 | 11/1982 | Bailey et al. | 439/357 |
| 4,371,228 | 2/1983 | Chalmers | 439/751 |
| 4,410,230 | 10/1983 | San Miguel | 439/79 |
| 4,611,878 | 9/1986 | Hall et al. | 439/353 |

FOREIGN PATENT DOCUMENTS

| | | | |
|---|---|---|---|
| 0960761 | 1/1975 | Canada | 439/744 |
| 2203513 | 8/1973 | Fed. Rep. of Germany | 439/851 |

*Primary Examiner*—David L. Pirlot
*Attorney, Agent, or Firm*—Bauer & Schaffer

[57] ABSTRACT

A socket usable, e.g., with an audio connector, comprises a plastics body having chambers running forwardly of the rear of the body and communicating with the front via apertures through which the connector pins pass. Each chamber receives and supports a bifurcated contact in a position to grip and engage a pin passed into the chamber via the aperture. The contacts are flat—blanked from sheet metal and edge portions of the heads are received in slots extending the length of the chambers. An edge of each contact has a tag twisted out of the plane of the contact and received in a deeper portion of one of these slots. Each contact extends rearwardly of the body to facilitate its electrical connection to a lead. Each contact has a tail and the tails of the different contacts may be of different lengths so that the tips of projections thereon lie in a plane. The projections of different contacts may be on the tail leading or trailing edges so they are at different distances from the plane of the rear of the body. The socket has a frontal slot to receive a skirt on the connector and a further chamber runs from the rear of the body to the slot. A clip is located in the further chamber with a hook part engaging the back of the slot and another part passing into the slot to engage and hold the skirt when it is inserted. The socket has a flange by which it can be fixed to equipment casing. The method of making the socket and an electrical circuit incorporating at least one socket are described.

11 Claims, 3 Drawing Sheets

ELECTRICAL SOCKET

Figure 1:
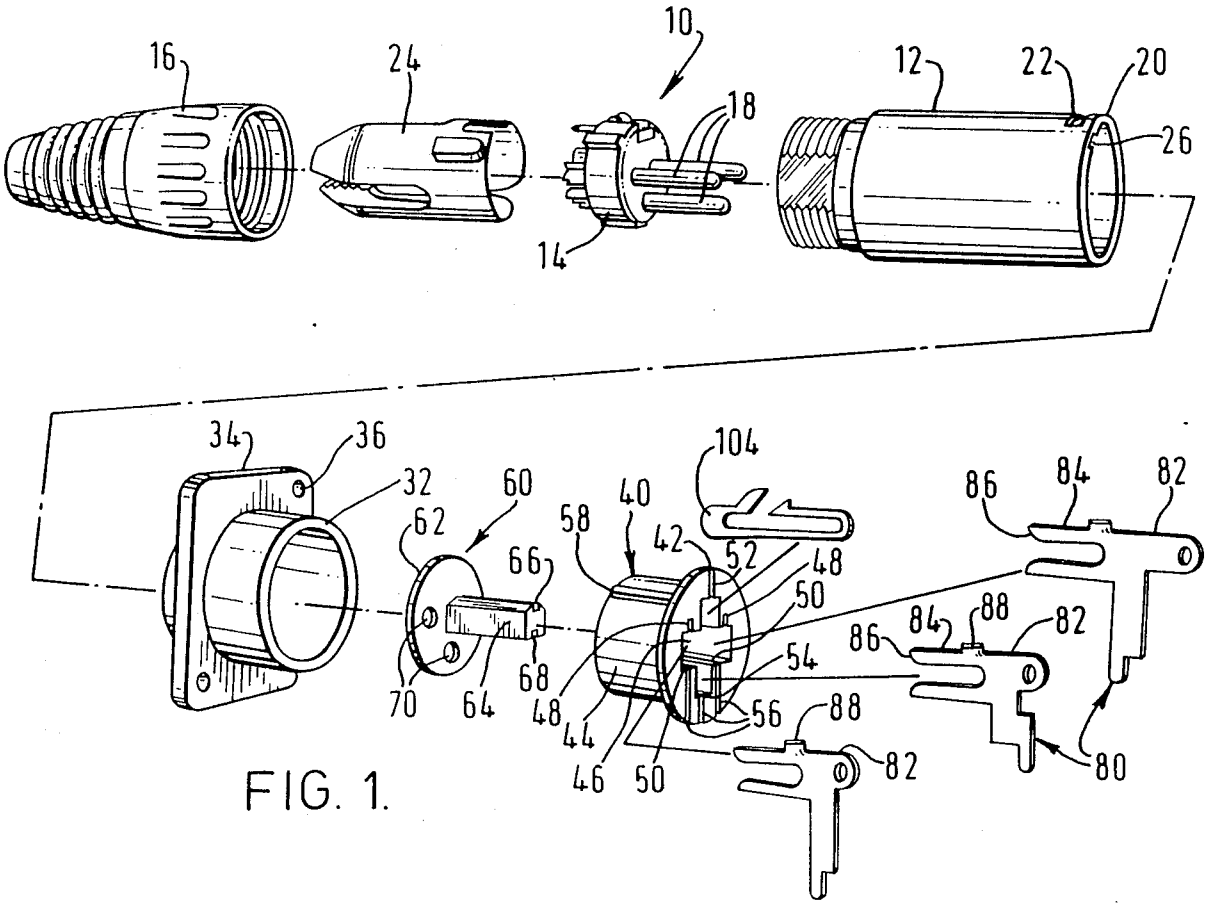

This is a continuation of Ser. No. 095,170, filed as PCT GB86/00717 on Nov. 24, 1986, published as WO87/03428 on Jun. 4, 1987, now abandoned.

DESCRIPTION

The invention concerns electrical sockets, in particular, but not exclusively, sockets for use with known forms of electrical connectors.

Electrical connectors comprising a body supporting on a face thereof one or more pins of predetermined size and disposition in use to be received in apertures of an electrical socket and to make contact therein with electrical contact elements are, known. Hereinafter such connectors will be referred to as electrical connectors of the kind defined.

Typically the electrical connectors used in audio electronics are connectors of the kind defined.

The sockets known to us for use with electrical connectors of the kind defined comprise moulded rigid plastics material bodies carrying electrical contacts which are machined from solid metal, or formed by bending or rolling metal sheet (or a combination of both). In use the pins of a connector coupled to such a socket are held in contact with the contact elements by being frictionally supported by the body material.

One disadvantage of this type of construction is that it requires a skilled work force and complicated and expensive machinery to accurately make the bodies, machine or form the contacts and fix the contacts in the bodies.

Another disadvantage is that the apertures for frictionally holding the pins can wear leading to difficulty in ensuring good electrical contact is made between the pins and the contact elements of the socket.

Objects of the invention include the provision of sockets for use with electrical connectors of the kind defined which may be made more cheaply and more readily than the sockets known to us, which are better adapted to hold a connector coupled thereto than the sockets known to us and which moreover are less prone to wear giving rise to the above noted difficulties.

In one aspect the invention provides an electrical socket for use with a connector of the kind defined, the socket comprising a body of plastics material in which resilient metal electrical contact elements for engaging pins of the connector are supported, wherein the contact elements are frictionally fitted in and supported by the body.

With advantage the body includes a plurality of chambers extending from a rear surface of the body towards the front surface thereof, said chambers communicate with said front surface by apertures through which the pins of said connector are passed, and wherein each contact element comprises a part supported and located in a respective one of said chambers in a position to engage and electrically contact a pin passing through said aperture thereinto.

The part of the contact element within each said chamber is desirably bifurcated to provide a parts lying on opposed sides of said chamber, said parts being shaped and configured so that a pin introduced into the socket passes between, is gripped and is engaged by said parts.

Preferably each contact element is flat, and edge portions thereof are frictionally received in slots extending along the length of the walls of the associated chambers. An edge of each contact element may carry a tag twisted out of the plane of the element and received in a portion of one of said slots of extended depth.

Each contact element may extend rearwardly of said rear surface of the body and be provided with an aperture to facilitate electrical connection of a lead thereto. The amounts by which the contacts extend rearwardly of the rear body surface differ.

With especial advantage the contact elements have tail parts which tail parts are provided with projections facilitating their termination of the contact onto a printed circuit board. The tails of different elements supported in the body may be of different lengths such that the tips of the projections thereon lie substantially in a plane. The projections on the tails of different elements supported by the body may be provided on the leading or trailing edges of thereof such that the projections on different elements are at different distances from the plane of the rear surface of the body.

The socket can further comprise a slot extending from the front face thereof and configured to receive a skirt provided on the connector and surrounding the pins thereof, a further chamber being provided extending from the rear surface of the body to a position communicating with said skirt and a clip element being provided within said further chamber so as to contact and engage the skirt as it is passed into said slot. With advantage the clip element is flat and is supported in said further chamber with a part thereof engaging the rearmost surface of said slot, and a resilient part extending into said slot to engage said skirt when it is inserted therein.

The socket body may have integrally formed therewith a flange by means of which the socket may be affixed to a casing of a piece of electrical equipment.

In another aspect the invention provides a method of making a socket embodying the invention which comprises the steps of moulding from plastics material, a socket body, having chambers extending from a rear surface towards a front surface thereof, which chambers communicate with said front surface by apertures through which pins of a connector may be passed, forming contact elements and a clip element by blanking from flat sheets of metal, and then inserting the contact and clip elements into the socket body by pushing those elements into said chambers from said rear surface of the body.

In a third aspect the invention provides an electrical circuit including at least one socket embodying the invention.

Figure 3:
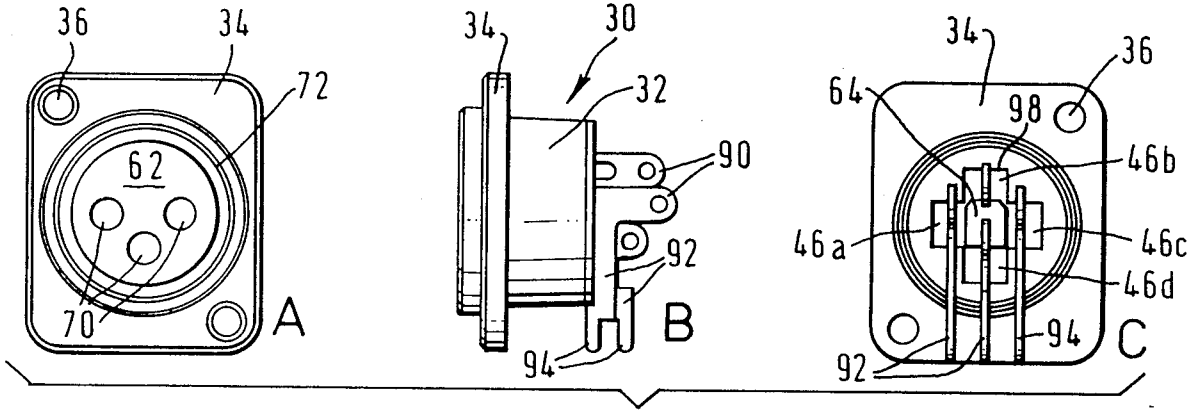
Figure 2:
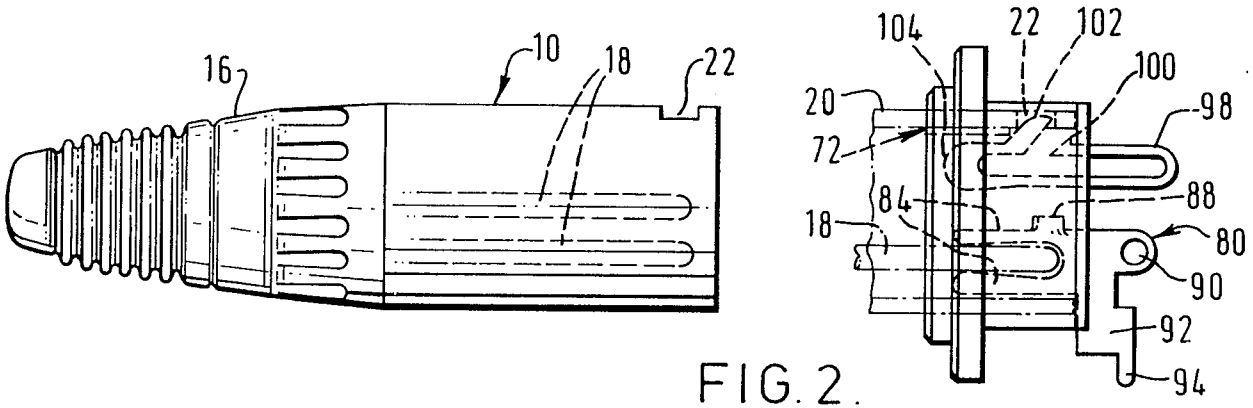
Figure 4:
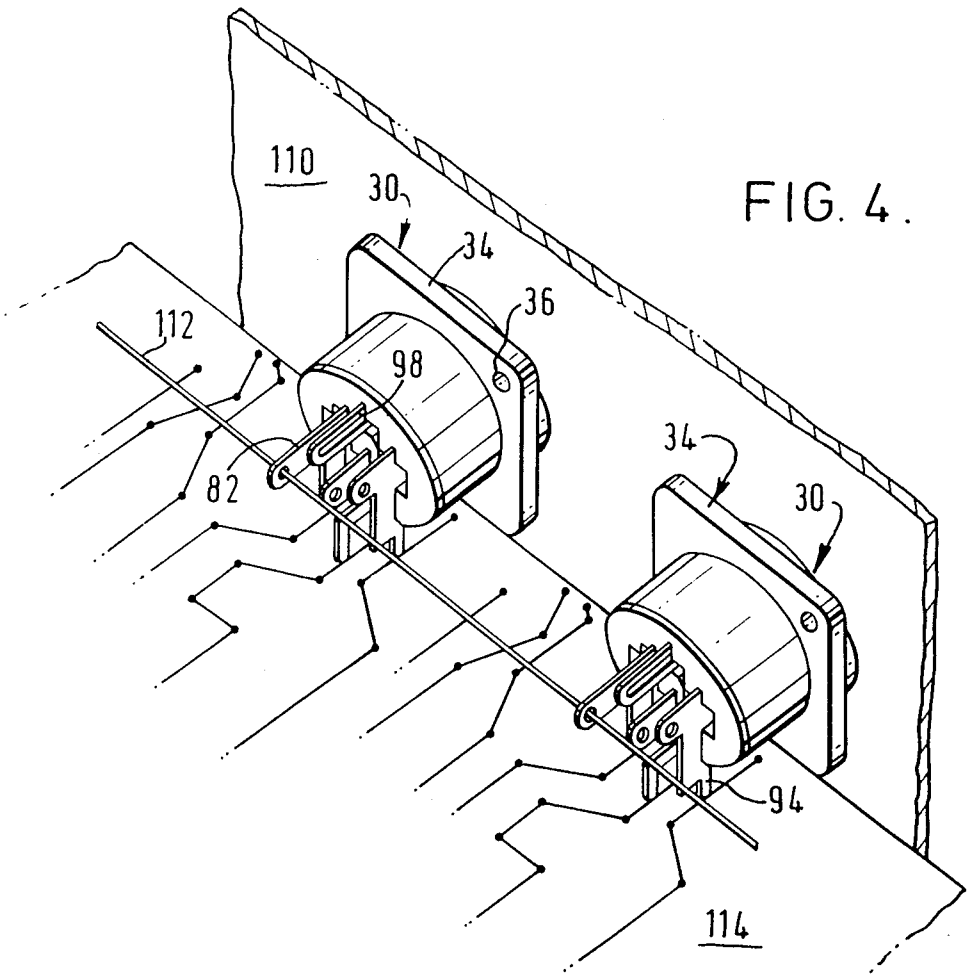

The above and other aspects, features and advantages of the invention will become apparent from the following description of various embodiments of the invention now made with reference to the accompanying drawings in which:

FIG. 1 is an exploded view of an audio connector and a socket therefor embodying the invention, FIG. 2 is a diagrammatic sectional side view of the connector and socket of FIG. 1, FIG. 3 shows at A, B and C front, side and rear views respectively of the socket of FIG. 1, FIG. 4 diagrammatically illustrates the use of sockets embodying the invention in a piece of electrical equipment.

With reference now the drawings the Figures show an audio connector 10 of standard form comprising a cylindrical metal shell 12 supporting a block 14 of moulded plastics material. Shell 12 threadably engages with a tapering, moulded plastics or rubber end part 16 open at both ends.

Three metal pins 18 pass through and extend to either side of block 14 as shown. The distance of each pin from the centre of the block 14 is the same so that the outer pair of pins are located somewhat above the middle one of the three. The shell 12 extends as a skirt 20 past the block 14 and the rightmost ends (as viewed in FIG. 1) of the three pins 18. The rightmost end of skirt 20 is formed with an aperture 22. The inner surface of the skirt 20 is provided with a shallow groove 26 running along its length to circumferential position of which groove is in predetermined relationship to the positions of the pins 18 of the connector 10.

Within shell 12 the ends of the pins remote from the skirt 20 are coupled in any suitable way (e.g. soldered) to the cores of a cable which is passed through the the end part 14. After coupling the cores of the cable to the pins 18 the end part 14 is screwed onto the shell 12. Desirably the connector 10 further includes a member 24 having resilient fingers which surround the cable and are forced into contact with the outer surface of it by the tapering inner wall of end part 14 (or a ring mounted therein) as the part 14 is screwed onto shell 12 to hold the cable firmly in the connector.

The connector 10 described is of a form commonly available and it will be appreciated the detail of the way in which it is formed may vary—however, certain features of the connector—the number and relative disposition of the pins, as well as the provision of a skirt is common to all forms of connector with which the socket 30 embodying the invention may be used.

Socket 30 comprises a single part formed of moulded plastics material (e.g. glass filled nylon), which for the sake of clarity has been shown FIG. 1 separated into three elements.

The first element of socket 30 is an outer body 32 of generally cylindrical form and with an integrally formed circumferential flange 34 pierced with apertures 36 through which screws and/or bolts may be passed to secure the socket to the casing of a piece of electrical equipment. The outer body 32 receives the second part of the socket 30 which comprises a first core member 40 having a circular end plate 42 closing the end of the outer body 32 and extending along the length thereof as shown.

This core member has a cylindrical section 44 located centrally on the end plate 42 with an outer diameter less than the inner diameter of main part of the outer body 32 by an amount substantially equal to the thickness of the skirt 20 of connector 10. Section 44 runs along the length of the main part of the cyLindrical body 32 as shown. The second part includes a cruciform aperture 46 which extends along its length—through the end plate 42 and along section 44—and has four arms **46*a*, 46*b*, 46*c* and 46*d* which are generally rectangular in section. Two of the arms—46*a* and 46*c*—are formed with slots 48 and 50 in their upper and lower walls respectively which slots extending along their lengths. The slots 48 are of slightly increased depth over the first part of their lengths in running from the plate 42**.

The uppermost (as viewed in the Figures) arm **46*b* of the aperture is formed with a slot 52 extending partway along its length and through the wall of the cylindrical section 44 whilst the lowermost arm 46*d* is formed with a slot 54 in its lower wall extending along its length as shown. The end plate 42 is formed with three shallow slots 56 extending downwardly as viewed from the arms 46*a*, 46*c* and 46*d* as shown. The outer surface of the cylindrical section 44 carries a shallow land 58 dimensioned to cooperate with the groove 26** of the skirt as will be described below.

The third element of the socket 30 comprises a second core member 60 having an end plate 62 closing the cruciform aperture 46 and carrying a centrally located generally square section spigot 64 extending along and substantially closing the central void of the cruciform aperture 46. The spigot has slots 66 and 68 respectively formed on its upper and lower walls which extend along its length. The depth of slot 68 is increased over the last part of its length—adjacent the free end of the spigot 64. End plate 62 is formed with three apertures 70 the spacing and relative disposition of which correspond to the spacing and disposition of the pins 18 of connector 10.

The three elements of the socket body are, as noted above, formed in a single moulding operation such the first core element extends forwardly from the rear of the outer body 32 and the spigot 64 of the second core element 60 extends rearwardly of the socket body within the central void of the cruciform aperture 46 of the first core element.

It will be seen that the socket body therefore comprises four chambers—**46*a*, 46*b*, 46*c* and 46*d*—which are open to the rear of the socket and communicate with the front face of of the socket (the front face of plate 62) via the three apertures 70, and a circular slot 72 lying between the wall of section 44 and the of the outer body part 32 to which the slot 52 leads from arm 46*b***.

The dimensions of the various elements of the socket 30 are selected so that the circular slot 72 receives the skirt 20 of connector 10 as the pins 18 of the connector pass into the chambers **46*a*, 46*c* and 46*c*** when the connector is pushed into engagement with the socket.

The socket 30 is completed by passing the heads of selected contact elements into the chambers **46*a*, 46*c* and 46*d* and a clip member into the chamber 46*b*. The contact elements 80 are formed by stamping from a flat metal sheet and the head 82 of each of them is, as can be seen, bifurcated. The outer edges of the two prongs 84 of each head 82 run generally parallel to one another, whilst the inner edges converge slightly along their length and terminate in rounded ends 86 as shown. The heads 82 are passed through the plate 42 into their associated chambers 46—the upper and lower portions respectively of the upper and lower prongs 84 being frictionally received in the upper (48,68) and lower slots (50,54) of the chambers 46*a*, 46*c* and 46*d***.

The top edge of each head 82 is further formed with an upstanding tag or lug 88 which is received in the section of the upper slot (48,68). The tags 88 are desirably twisted out of the plane of the head 82 as the contact is being made so that the contact 80 is firmly held in the socket body once inserted therein.

The heads 82 extend rearwardly and their rearmost ends are pierced by holes 90 to which a wire may readily be fixed (e.g soldered).

Each contact 80 further comprises a tail 92 depending from the head 82 as shown. The lengths of the tails of the two outer contacts shown in the Figures are substantially the same whilst the length of the centre contact is less so that the bottom ends of all the tails of all three contacts are substantially at the same level.

The lowermost end of each tail 92 is formed with a projection 94 enabling it to be terminated onto a printed circuit board.

To fit the contacts in the socket body their heads 82 are simply pushed into the chambers 46*a*, 46*c* and 46*d* the upper and lower portions of the prongs 84 entering into the slots upper and lower slots of those chambers and the lugs 88 being received in the sections of increased depth of the upper slots 48 and 68).

When the contact head is fully entered into its associated chamber the leading edge of the tail 92 enters into the associated shallow slot 54 on the rear face of the end plate 42.

The contacts inserted into the chambers 46*a*, 46*c* and 46*d* are selected such that the projections 94 of the tails 90 are all at the same level enabling the socket to be terminated on a printed circuit board if desired. Again, the elements are selected with the projections 94 at the leading or trailing edges of the tails 92 to so that the socket may be adapted to conform to a particular circuit configuration on the printed circuit board.

The chamber 46*b* receives a clip 98 comprising an elongate generally oval body the upper edge (as viewed in the Figures) is slit as shown and formed with a barb 100 and upstanding portion 102. The leading end 104 of element 98 is of slightly increased size and depends marginally below the rest of the bottom edge of the element.

As the element 98 is pushed into the chamber 46*b* its upper and lower edges are located in the slots 52 and 66. The element is pushed into the chamber the until the portion 102 and barb 100 pass into the slot 72 formed between the outer body member 32 and the first core member 40. The clip 98 is thereafter held in that position—the barb preventing its removal from the socket 30 to hold the element in position.

The socket once formed may be mounted in an aperture in an equipment casing 110 and fixed in position by passing screws through the apertures 36 in the flange 34 (see FIG. 4). An advantage of the arrangement now described is that certain of the contacts may be selected so that their heads extend further rearwardly of the socket 30 than the heads of the other contacts enabling a common connection (e.g. an earth connection) to be made directly to those contacts as shown at 112 in FIG. 4. It can also be seen from FIG. 4 that the lengths of the tails 92 have been selected so that the projections 94 thereon are all at the same level enabling their ready termination on a printed circuit board 114. Furthermore the contacts have been selected so that the projections on the outermost two contacts are on the leading edges of the tails and are therefor closer to the plane of the end plate 42 than the projection on the centre contact which has its projection on the trailing edge of the tail thereof. This particular configuration aids the support of the socket on the printed circuit board—the three points of contact are not "inline".

In use the connector 10 is pushed into engagement with the socket 30, the skirt 20 entering the slot 72 and the pins 18 entering the chambers 46*a*, 46*c* and 46*d*. The correct angular relationship of the pins 18 with the apertures 70 is ensured by the land 58 which prevents the skirt 20 entering slot 72 unless the land 58 and groove 26 are in register.

As the skirt enters the circular slot 72 its leading edge passes over and pushes down the upstanding portion 102 of the element 98 (the depending section 104 being forced against the bottom of the chamber 46*b*) until the aperture 22 rides over the upstanding portion 104 which then springs upwardly into the aperture 22 to hold the skirt 20 and therefor the connector 10 firmly in the socket.

As the connector is engaged with the socket the pins 18 pass through the apertures 70 and enter the chambers 46*a*, 46*c* and 46*d* and in entering these chambers the pins 18 pass between the rounded ends 86 of the prongs 84 of the contacts 80; pushing the prongs apart. The prongs 84 flex so that their inner surfaces contact and grip the pins 18.

To remove the connector from the socket a user grasps the connector body and simply pulls it away from the socket. The pins 18 are pulled out of engagement with the contacts of the socket and the edge of the aperture 22 in the skirt 20 forces the upstanding portion 102 of the clip 98 downardly enabling the skirt to pass out of the slot 72.

The contact elements 80 are formed from flat sheets of nickel/silver or silver plated phosphor-bronze which are 0.024"–0.028" (0.6 mm–0.7 mm) thick and are simply formed in a blanking operation, their lugs 88 being twisted out of the plane of the contact as the element is made.

The elements 98 are similarly simply formed in a blanking operation from a flat sheet of spring steel which is again 0.024"–0.028 (0.6 mm–0.7 mm) thick.

The clip 98 coupling the connector and socket offers particular advantages over the arrangements known to us which are either not provided with means for holding the connector and socket together or provide some form of separate latching mechanism which—it has been found in practice—will rattle when vibrated (for example when the socket is fixed in a loud speaker casing).

It will be appreciated that various modifications may be made to the arrangements described herein without departing from the scope of the invention.

For example the groove 26 and land 58 may be reversed (or even omitted), and other known methods of ensuring the correct registration of the pins 18 with the apertures 70 provided.

The number of contacts in the socket may be more or less than the number (three) described and their relative positions may differ to accomodate connectors in which there are more or less pins 18 at various spacings from the centre line of the connector.

It will be appreciated that the arrangements now described are not limited to use with connectors having pins of equal diameter—the apertures in the plate 70 and the contacts 80 may be selected to accomodate different sizes of pin in a single connector.

Although the contacts are described as having tails the lengths of which are selected to enable ready termination on a printed circuit board it will be seen that this need not be the case if not desired—indeed the tails may be omitted from the contacts if it is not required to use them.

It will be appreciated that the elements of the socket body may be made separately and then conjoined using a suitable adhesive or solvent welding techniques.

Finally, the particular materials used to make the socket body, the contacts and the clip may be varied to suit particular user requirements.

It will be seen that that the arrangements now disclosed offer considerable advantages over the known socket arrangements for use with electrical connectors of the kind defined formed of moulded rigid plastics material in use frictionally supporting pins of the connector in contact with electrical contacts machined from solid metal, or formed by bending or rolling metal sheet.

The particular form of socket body now disclosed is simply moulded, the contacts and clips therefor are simply blanked from sheet metal and are then simply pushed into position in the body—the slots in which they are received acting to accurately locate them in the desired position. Again, the pins of the connector are held within the socket directly by the contact elements and are not supported by the material of the socket body

I claim:

1. An electrical socket for use with a connector comprising a body supporting on one face thereof one or more pins of predetermined size and disposition which in use are received in apertures in the socket, the socket comprises a body of plastics material having front and rear surfaces, a plurality of chambers each extending from said rear surface toward said front surface and communicating with said front surface by way of an individually associated aperture the diameter of which is less than the diameter of the chamber, a contact element supported in each said chamber in a position to engage and electrically contact a pin of a said connector for use with the socket passed thereto from said front surface and through said individually associated aperture, each said contact element being of resilient metal construction and comprising an elongate first part which is substantially flat and has edge portions, said first part of each said contact element being supported in said chamber in which it is located with at least one edge portion thereof received in a slot formed in a wall of the chamber to extend the length thereof from said rear surface, and wherein the depth of one of said slots extending over a part of its length forwardly from the rear surface of the body is of greater depth than the remainder of the length of said slot, the edge portion of the said first part of each contact element is formed with a tag which extends in the plane of said first part away from said edge portion and is received in said part of said at least one slot of said greater depth, and wherein said tag is twisted out of the plane of the said first part of said contact element such that edges of said tag bear against walls of said part of said at least one slot of said greater depth.

2. The socket according to claim 1, including an annular slot formed in said front surface, said annular slot configured to receive a conformingly shaped skirt provided on the connector which skirt surrounds the pins of the connector, the body of said socket including a further chamber extending from the rear surface of said socket body to a position communicating with the annular slot, and wherein said clip element is of resilient metal construction and is substantially flat and is supported in said further chamber with a resilient part thereof extending into the annular skirt receiving slot to engage the connector skirt when the connector is inserted in said socket.

3. The socket as claimed in claim 1, wherein said first part of each contact element within each said chamber is bifurcated to provide parts laying on opposed sides of said chamber, said parts being shaped and configured so that a pin introduced into the socket passes between, is gripped and is engaged by said parts.

4. A socket as claimed in claim 3, wherein each said contact element has a substantially flat tail part which extends rearwardly of said rear surface of the body and is provided with an aperture to facilitate electrical connection of a lead thereto.

5. A socket as claimed in claim 4, wherein the amounts by which the contacts extend rearwardly of the rear body surface differ.

6. A socket as claimed in claim 3, wherein each of the contact elements has a tail provided with a projection facilitating the termination of the contact element onto a printed circuit board.

7. A socket as claimed in claim 6, wherein the tail parts of the different contact elements supported in the body are of different lengths such that the tips of the projections thereon lie substantially in a plane.

8. A socket as claimed in claim 6, wherein the projections on the tail parts of different contact elements supported by the body are provided on the edges thereof which are closer or further from the plane of the rear surface of the body such that the projections on the different elements are at different distances from the plane of the rear surface of the body.

9. A socket as claimed in claim 8, wherein the body part has integrally formed therewith a flange by means of which the socket may be affixed to a casing of a piece of electrical equipment.

10. A method of making an electrical socket comprising the steps of moulding, from plastics material, a socket body having front and rear surfaces, and a plurality of chambers each extending from said rear surface towards said front surface and communicating with said front surface by way of an individually associated aperture the diameter of which is less than the diameter of the chamber each chamber having at least one slot formed in a wall thereof to extend the length of the chamber from said rear surface and the depth of one of the at least one of said slots of each chamber extending over a part of its length forwardly from the rear surface of the body being of greater depth than the remainder of the length of said slot, forming from resilient flat metal at least one contact element and a clip element, the contact elements comprising an elongate first part which is substantially flat and had edge portions, an edge portion of the said first part of each contact element being formed with a tag which extends in the plane of said first part away from said edge portion and is twisted out of the plane of the said first part, and then inserting said first part of each said contact element and each said clip element into the socket body by pushing them into said chambers from said rear surface of the body so that each is supported and located in a respective one of said chambers with said contact element in positions to engage and electrically contact a pin passing through said aperture thereinto, and so that the first part of each said contact element is located with at least one edge portion thereof received in one of said slots and with said tag thereof received in the greater depth of said at least one slot whereby the edges of said tag bear against walls of said slot.

11. The method according to claim 10 including the step of forming an annular slot in the front surface of said socket body configured to receive a skirt portion formed on the associated connector, forming a chamber extending from the rear surface of said socket body to a position communicating with said annular slot, inserting within said chamber, a substantially flat conductive clip element, said chip element having a resilient part extending into said annular slot to engage the skirt portion provided on the associated connector.

* * * * *